US005950056A

United States Patent [19]

Hamamichi et al.

[11] Patent Number: 5,950,056

[45] Date of Patent: Sep. 7, 1999

[54] DEVELOPING DEVICE PROVIDED WITH THREE DEVELOPER TRANSPORT MEMBERS

[75] Inventors: Suguru Hamamichi; Mineyuki Sako; Kentaro Katori, all of Toyokawa; Shinichi Yoshimoto, Aichi-ken, all of Japan

[73] Assignee: Minolta Co., Ltd., Osaka, Japan

[21] Appl. No.: 09/097,811

[22] Filed: Jun. 16, 1998

[30] Foreign Application Priority Data

Jun. 17, 1997 [JP] Japan ..... 9-159998
Oct. 27, 1997 [JP] Japan ..... 9-294198

[51] Int. Cl.[6] ..... G03G 15/08

[52] U.S. Cl. ..... 399/256

[58] Field of Search ..... 399/254, 255, 399/256, 272, 281

[56] References Cited

U.S. PATENT DOCUMENTS 4,800,412 1/1989 Ueda .
4,864,349 9/1989 Ito .

FOREIGN PATENT DOCUMENTS 05333691 12/1993 Japan .
06051634 2/1994 Japan .
06186841 7/1994 Japan .

*Primary Examiner*—Joan Pendegrass
*Attorney, Agent, or Firm*—McDermott, Will & Emery

[57] ABSTRACT

A developing device capable of preventing a reduction of image quality due to disparities in image density or fogging and the like that result from an nonuniform toner concentration or static charge status due to inadequate mixing of a developer. The developing device is provided with a mixing screw for mixing a developer separately from a supply screw for supplying a developer to a developing roller and a collection screw for collecting a developer from the developing roller, the transport direction of the mixing screw being opposite to the transport direction of the supply screw and collection screw.

17 Claims, 6 Drawing Sheets

FIG. 10 <PRIOR ART>
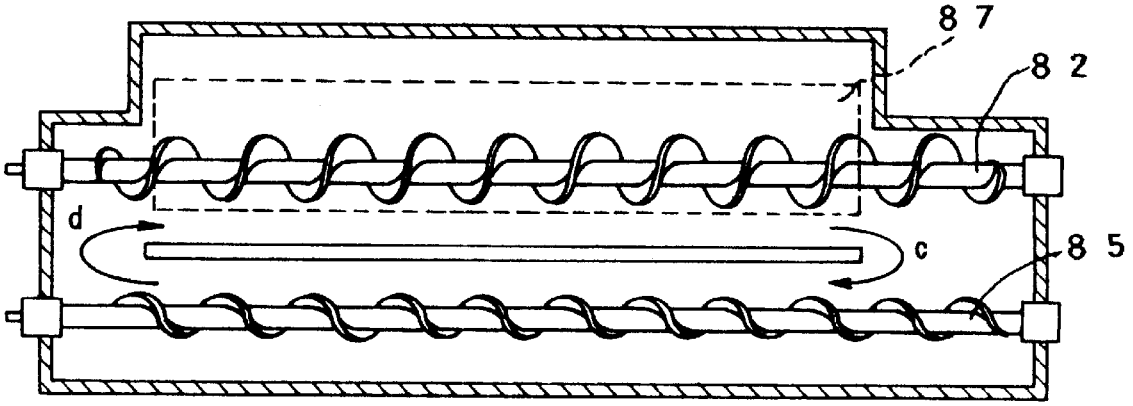

DEVELOPING DEVICE PROVIDED WITH THREE DEVELOPER TRANSPORT MEMBERS

CROSS-REFERENCE TO RELATED APPLICATIONS

This application is based on Application Nos. 9-159998 and 9-294198 filed in Japan, the contents of which are hereby incorporated by reference.

BACKGROUND OF THE INVENTION

1. Field of the Invention

The present invention concerns a developing device used in a copy machine, printer, or other such electrophotographic image forming apparatus, and more specifically relates to a developing device wherein the supply of a developer to a developing roller or other such developer carrier is functionally separated from the collection and mixing of said developer, and wherein said developing device affords the supply of an adequately mixed developer to a developer carrier.

2. Description of the Related Art

An example of a conventional developing device is described in Japanese Laid-Open Patent Application No. HEI 5-333691. As shown in FIG. 10, said developing device disposes two augers (screws) 82 and 85 such that their respective directions of transport are mutually opposed. Thus, a developer is thereby circulated as indicated by arrows c and d and is supplied to developer carrier (developing roller) 87 provided adjacent to auger 82, and an electrostatic latent image is thereby developed on a photosensitive medium. In this developing device, auger 82 supplies a developer to developer carrier 87, and auger 85 collects the developer from developer carrier 87.

The aforementioned conventional developing device is disadvantageous inasmuch as the space for mixing the developer is insufficient. As a result, there is a risk that developer with a low toner concentration collected from developer carrier 87 by auger 85 will simply be resupplied to developer carrier 87 by auger 82 without adequate blending. Additionally, when toner is replenished, there is also a risk that the replenished toner will simply be supplied to developer carrier 87 by auger 82 before it is uniformly dispersed in the developer and adequately charged. Owing to these facts, nonuniformity of toner concentration in the developer and inadequate toner charging have at times produced disparities in image density, as well as fogging. Such phenomena occur readily particularly when large area images consuming large quantities of toner are developed continuously. Thus, usage has been a particular problem in a color image forming apparatus which frequently handles original documents containing large area images.

SUMMARY OF THE INVENTION

An object of the present invention is to offer an improved developing device which eliminates the aforementioned disadvantages.

A further object of the present invention is to offer an improved developing device so devised as to ensure a space for mixing a developer and to supply an adequately mixed developer to a developer carrier, thereby preventing a reduction of image quality due to disparities or fogging.

The aforementioned several objects are attained by providing a developing device comprising:

a developing roller which carries a developer and thereby supplies the developer for developing;

a supply screw which transports a developer along the axial direction of the aforementioned developing roller and supplies said developer to the aforementioned developing roller;

a collection screw which collects a developer from the aforementioned developing roller and transports said developer along the axial direction of said developing roller, wherein the developer transport direction of said collection screw is the same as the developer transport direction of the aforementioned supply screw; and a mixing screw which performs mixing while transporting a developer in a direction opposite to the developer transport direction of the aforementioned supply screw and collection screw.

In the above-noted developing device, the aforementioned mixing screw may be disposed above the aforementioned supply screw and collection screw. Additionally, in such an instance, the aforementioned supply screw may be disposed above the aforementioned collection screw.

In the above-noted developing device, the aforementioned mixing screw may be disposed below the aforementioned supply screw and collection screw. Additionally, in such an instance, the aforementioned supply screw may be disposed above the aforementioned collection screw or disposed at the same height as the aforementioned collection screw.

As concerns the developer transport direction of the aforementioned mixing screw, it is also preferable that a developer supply port be furnished in the aforementioned developing device at the upstream side of a region which confronts the aforementioned developing roller. In addition, the transport capacity of the aforementioned mixing screw is preferably larger than the transport capacity of the aforementioned supply screw and collection screw, respectively. This may be achieved, for example, by making the screw diameter of the aforementioned mixing screw larger than the screw diameter of the aforementioned supply screw and collection screw, respectively.

The aforementioned several objects are also attained by providing a developing device comprising:

a developer carrier which carries a developer and thereby supplies the developer for developing;

a first transport member which supplies a developer to the aforementioned developer carrier while transporting said developer;

a second transport member which collects a developer from the aforementioned developer carrier and transports said developer in the same direction as the aforementioned first transport member; and a third transport member which performs mixing while transporting a developer in a direction opposite to the developer transport direction of the aforementioned first and second transport members.

BRIEF DESCRIPTION OF THE DRAWINGS

These and other objects and features of the present invention will become clear from the following description taken in conjunction with the preferred embodiments thereof with reference to the accompanying drawings, in which:

FIG. 10 is a drawing describing the structure of a conventional developing device.

DETAILED DESCRIPTION OF THE PREFERRED EMBODIMENTS

Preferred embodiments of the present invention are described in detail below with reference to the accompanying drawings. Each of the following embodiments is a developing device used to develop an electrostatic latent image formed on an electrostatic latent image carrier (e.g., a photosensitive drum) in an electrophotographic-type image forming apparatus. These developing devices use, as a developer, a two-part developer comprising a toner and a carrier.

Figure 1:
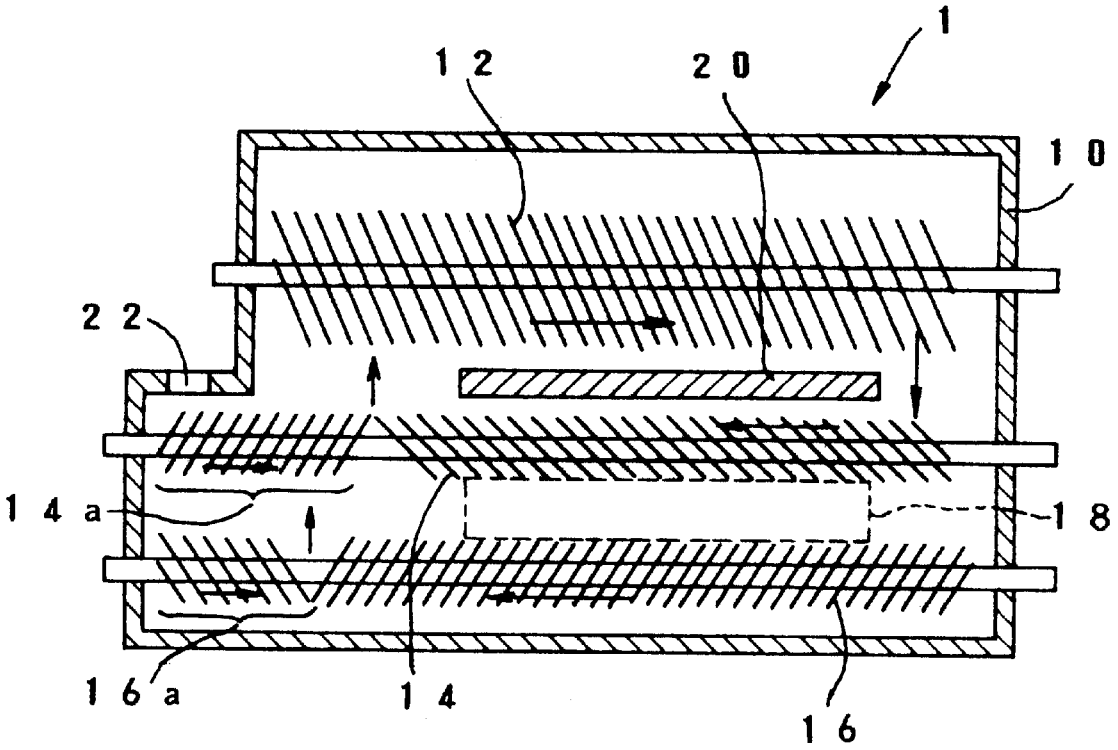
FIG. 1 is a drawing describing the structure of a developing device pertaining to a first preferred embodiment.
Figure 2:
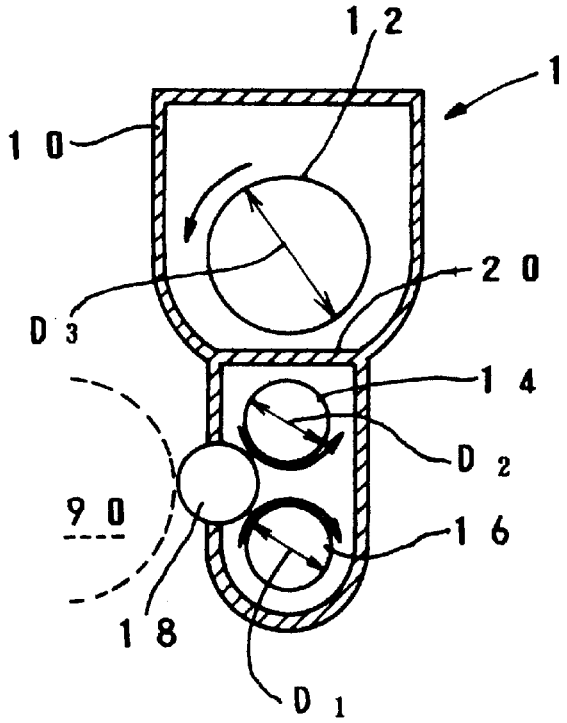
FIG. 2 is a side cross-sectional view of the developing device pertaining to FIG. 1.

FIG. 1 is a drawing illustrating the structure of developing device 1 pertaining to a first preferred embodiment. In developing device 1, as shown in FIG. 1, the three members of mixing screw 12, supply screw 14, and collection screw 16 are provided parallel to each other within developer reservoir 10. In each of these members, multiple screw vanes are furnished obliquely at a rotatable axis. As shown in the side cross-sectional view of FIG. 2, these three screws are disposed in a vertically stacked manner and respectively positioned with mixing screw 12 at an upper level, supply screw 14 at a central level, and collection screw 16 at a lower level. Reverse thread segments 14*a* and 16*a* whose direction of screw vane inclination is opposite that of other areas are provided at a portion of supply screw 14 and collection screw 16, respectively, and reverse thread segment 14*a* of supply screw 14 is longer than reverse thread segment 16*a* of collection screw 16. A reverse thread segment is not provided on mixing screw 12.

Developing roller 18 is provided in a state partially protruding from developer reservoir 10, in a vertical location between supply screw 14 and collection screw 16, within a region other than that of reverse thread segment 14*a* on supply screw 14; and developing roller 18 carries a developer on its surface and supplies said developer for developing. Partition 20 is provided between mixing screw 12 and supply screw 14. The provision of partition 20 is limited to the region directly confronting developing roller 18, and the upper and lower spaces communicate at both the left and right sides within FIG. 1. In addition, toner replenishing port 22 is provided at a location directly above reverse thread segment 14*a* of supply screw 14, in developer reservoir 10. Viewed from the region where developing roller 18 is present, this location is the upstream side of the transport direction of mixing screw 12.

Developing device 1 allows the three members of mixing screw 12, supply screw 14, and collection screw 16 to accept rotary drive from a motor (not illustrated) provided in the image forming apparatus unit. Among these, supply screw 14 and collection screw 16 are devised such that their rotational directions are mutually opposed. Within FIG. 1, this rotational drive produces a leftward flow of developer at the segments of supply screw 14 and collection screw 16 other than reverse thread segments 14*a* and 16*a*, a rightward flow at reverse thread segments 14*a* and 16*a*, and a rightward flow at mixing screw 12. This flow circulates a developer through the inside of developing device 1. In the following description, the "transport direction" of supply screw 14 or collection screw 16 refers to the transport direction at segments other than reverse thread segments 14*a* and 16*a*.

Where the diameter of mixing screw 12, supply screw 14, and collection screw 16 is concerned, diameter D1 of supply screw 14 and diameter D2 of collection screw 16 are alike, and diameter D3 of mixing screw 12 is larger than these. Thus, mixing screw 12 has a larger developer transport capacity than the underlying two screws 14 and 16.

In an image forming apparatus, developing device 1 is disposed such that developing roller 18 is positioned parallel and in close proximity to photosensitive drum 90, and developing device 1 operates as follows.

When mixing screw 12, supply screw 14, and collection screw 16 are rotated by drive from a motor provided in the image forming apparatus unit, the transporting force of each screw generates a flow of developer within developer reservoir 10. In the area above partition 20, mixing screw 12 produces a rightward flow within FIG. 1. Developer which has reached the right end of mixing screw 12 in FIG. 1 by means of this flow, that is, the downstream end, falls by gravity because partition 20 is not present at that point, and this developer thereby migrates to the underlying supply screw 14. In the area beneath partition 20, supply screw 14 and collection screw 16 orient the flow of developer leftward in FIG. 1, with the exception of reverse thread segments 14*a* and 16*a*. Developer which has reached the left end of supply screw 14 and collection screw 16 in FIG. 1 by means of this flow, that is, the downstream end, is spewed upward by the reverse transport of reverse thread segments 14*a* and 16*a* and thereby migrates from collection screw 16 to supply screw 14, and then from supply screw 14 to mixing screw 12. In this way, developer within developer reservoir 10 is circulated clockwise within FIG. 1, about a center of partition 20.

Developer transported leftward in FIG. 1 by supply screw 14 and developer transported leftward in FIG. 1 by collection screw 16 converge and the confluence flows into the upstream end of mixing screw 12. As stated above, because mixing screw 12 has a larger transport capacity than supply screw 14 and collection screw 16, there is no stasis of developer at this region due to an insufficient transport capacity of mixing screw 12. Thus, the circulation of developer within developer reservoir 10 is performed smoothly.

In this circulation of developer, mixing screw 12 is responsible for mixing the developer. In other words, mixing screw 12 creates a uniform toner concentration and static charge in the developer. Likewise, supply screw 14 is responsible for supplying developer to developing roller 18, as is collection screw 16 for collecting excess developer from developing roller 18. Consequently, developer which has arrived downstream of supply screw 14 and collection screw 16 and migrated to mixing screw 12 is mixed during rightward transport in FIG. 1 by large transport capacity mixing screw 12, without being provided for supply to developing roller 18. Thus, the developer is adequately mixed when migrating from the downstream end of mixing screw 12 to supply screw 14, and toner concentration and static charge are in a uniform state. Consequently, developing roller 18 performs developing free from density disparities caused by nonuniform toner concentration and from fogging caused by insufficient static charge.

The toner concentration of developer collected from developing roller 18 by collection screw 16 is reduced by the amount of toner consumed by developing. Thus, if developing is continued without change, the toner concentration throughout the developer will decline gradually; therefore, toner must be injected from toner replenishing port 22 to supplement the concentration as appropriate.

Injected toner falls on reverse thread segment 14*a* of supply screw 14 and is therefore first transported rightward in FIG. 1. Then, the injected toner converges with developer migrating from collection screw 16 to supply screw 14 and developer transported leftward in FIG. 1 along the segment of supply screw 14 other than reverse thread segment 14*a*, and migrates to mixing screw 12. Toner just injected is not adequately blended with the developer as a whole, and its static charge is also inadequate. Prior to reaching supply screw 14 and being supplied to developing roller 18, however, said toner is transported rightward in FIG. 1 along nearly the entire length of mixing screw 12 and is adequately mixed in that interval. Thus, when migrating from the downstream end of mixing screw 12 to supply screw 14, injected toner has been adequately blended with the developer as a whole and has assumed a uniform toner concentration; the state of static charge is also good. Consequently, even when toner is injected from toner replenishing port 22, developing roller 18 performs developing free from density disparities caused by nonuniform toner concentration and from fogging caused by insufficient static charge.

This good mixing of developer is realized not only by providing mixing screw 12 separately from supply screw 14 and collection screw 16, but also by making the transport direction of supply screw 14 and collection screw 16 identical and by making the transport direction of mixing screw 12 opposite thereto. In other words, the circulatory paths conceivable by means of three screws including a mixing screw include the three illustrated representationally in FIG. 3, FIG. 4, and FIG. 5. The circulatory path in developing device 1 of this embodiment is that shown in FIG. 3.

Figure 4:
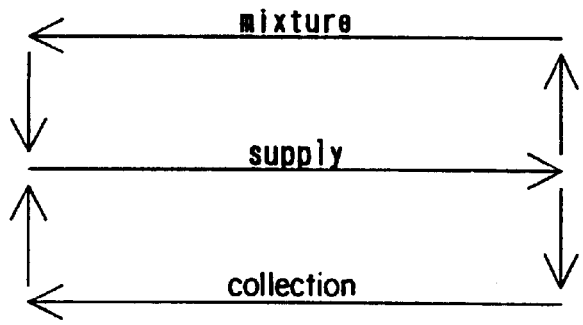
FIG. 4 is a representational drawing illustrating another circulatory path for purposes of comparison.
Figure 5:
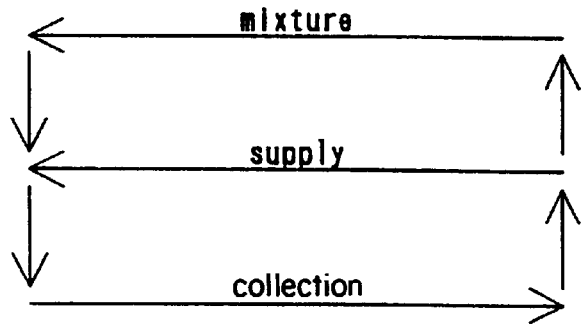
FIG. 5 is a representational drawing illustrating another circulatory path for purposes of comparison.

The circulatory path in FIG. 4 is one in which the mixing screw and collection screw are given the same transport direction and that of the supply screw is reversed. The circulatory path in FIG. 5 is one in which the mixing screw and supply screw are given the same transport direction and that of the collection screw is reversed. In these circulatory paths, although a space itself for mixing is provided, a developer can circulate while bypassing the mixing screw. Therefore, developer is supplied from the collection screw to the supply screw without travelling across a mixing screw. As a result, there is little apparent effect from providing a mixing screw. Additionally, in the circulatory path pertaining to FIG. 4, developer falling from the mixing screw obstructs the migration of developer from the collection screw, and smooth circulation cannot be achieved. In the circulatory path pertaining to FIG. 5, developer migrating from the collection screw flows almost entirely to the supply screw, barely flowing into the mixing screw.

Figure 3:
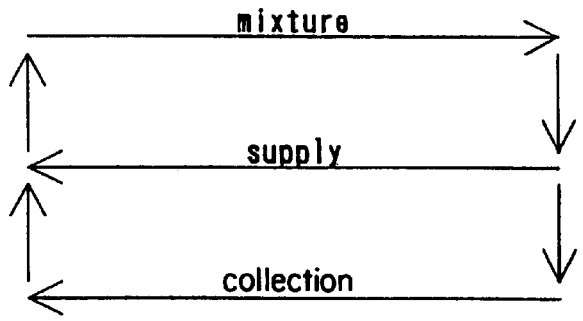
FIG. 3 is a representational drawing illustrating the circulatory path of a developer in the developing device pertaining to FIG. 1.

In contrast, in the circulatory path of developing device 1 shown in FIG. 3, developer cannot bypass the mixing screw and then circulate. Thus, there is no supply to supply screw 14 of developer that has not traveled across mixing screw 12, and the effect of providing mixing screw 12 is greatly apparent. In addition, since the transport capacity of mixing screw 12 in this circulatory path is necessarily large, better mixing is performed at mixing screw 12.

As described in detail above, according to developing device 1 pertaining to the foregoing first preferred embodiment, a mixing screw 12 handling the mixing of developer is provided separately from a supply screw 14 and a collection screw 16, which respectively handle the supply and collection of developer to developing roller 18, and the transport direction of mixing screw 12 is opposite the transport direction of supply screw 14 and collection screw 16. Thereby, developer transported further downstream by supply screw 14 or collection screw 16 must travel across mixing screw 12 before being resupplied upstream of supply screw 14, and said developer is thereby mixed adequately. As a result, a superior developing device is realized which does not cause disparities in image density or fogging and the like that result from an inflow to screw 14 of a developer with a nonuniform toner concentration or static charge status due to inadequate mixing.

In addition, because diameter D3 of mixing screw 12 is made larger than diameter D1 of supply screw 14 or diameter D2 of collection screw 16, the transport capacity of mixing screw 12 is larger than the transport capacity of supply screw 14 or collection screw 16, and thus, a developing device is realized which performs smooth circulation free from stasis of developer at downstream regions of supply screw 14 or collection screw 16. Additionally, the large transport capacity of mixing screw 12 affords better mixing of developer at mixing screw 12 and more reliably eliminates nonuniformity in toner concentration or static charge status.

In addition, since the three members of supply screw 14, collection screw 16, and mixing screw 12 are disposed vertically, a compact developing device with a small width dimension (the left-right orientation in FIG. 2) is realized. This is particularly suitable for a color image forming apparatus equipped with a plurality of developing devices.

Furthermore, since toner replenishing port 22 is provided directly above reverse thread segment 14*a* at the downstream portion of supply screw 14, newly replenished toner is necessarily mixed together with the developer as a whole at mixing screw 12 before said toner flows into supply screw 14. Thus, by the time said toner flows into supply screw 14, it blends adequately with the developer as a whole and thereby achieves a uniform concentration as well as a state of good static charge. Consequently, even when toner replenishment is carried out, as when large area images consuming considerable toner are developed continuously, a superior developing device is realized which is free from such occurrences as an instance in which inadequate mixing results in a nonuniform toner concentration or charge status in a developer, and said developer flows into supply screw 14, causing disparities in image density or fogging. This point in particular offers a developing device in which problems do not arise, even when used in a color image forming apparatus that frequently handles original copy including large area images.

Figure 6:
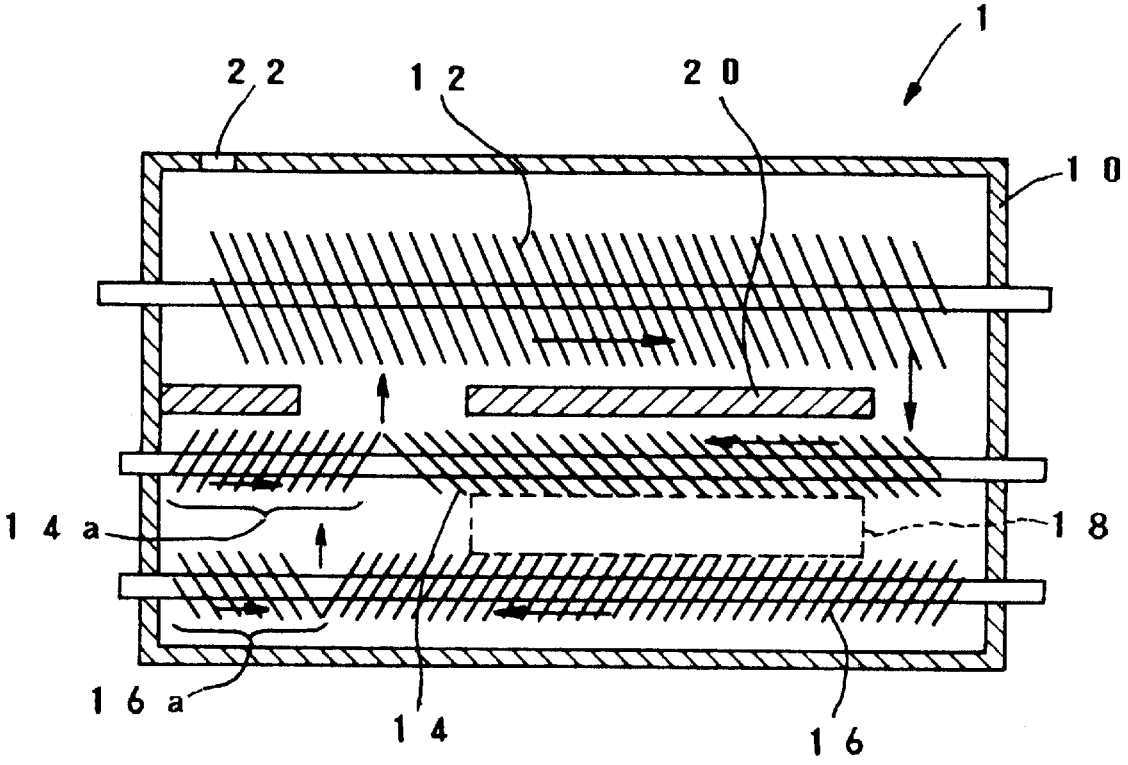
FIG. 6 is a drawing illustrating a modified example of the developing device pertaining to the first preferred embodiment.

The foregoing first preferred embodiment is merely a simple example which in no way limits the present invention. Consequently, the present invention may of course be variously improved or modified within a scope not deviating from its essence. For example, in the first preferred embodiment, mixing screw 12 was made slightly shorter than supply screw 14 and collection screw 16 to provide toner replenishing port 22 at a position directly above reverse thread segment 14*a* of supply screw 14, but as shown in FIG. 6, the length of mixing screw 12 may be made the same as the length of supply screw 14, etc., and toner replenishing port 22 may be provided at a position directly above the upstream end of mixing screw 12. In the form of the present embodiment, the transport capacity of mixing screw 12 was made larger than the transport capacity of other screws by adjusting each screw diameter, but there is no such limitation, and adjustment may also be accomplished by means of the axial diameter, effective central angle of the screw vane, pitch, or number of threads, etc. The developer is also not limited to a two-part system and may be a one-part system.

As the foregoing description makes clear, because the first preferred embodiment secures a space for mixing a developer, a developing device is offered wherein only an adequately mixed developer is supplied to a developing roller and a reduction of image quality due to disparities or fogging does not readily occur. In addition, a developing device is also offered wherein smooth circulation of a developer is not impaired by insufficient transport capacity of a mixing screw and adequate mixing of a developer is performed within a mixing screw. In addition, three screws are disposed in a lengthwise direction, offering a compactly integrated developing device. In addition, a developing device is offered wherein, even when a developer is replenished, by the time the replenished developer reaches a supply screw, it is adequately blended with the developer as a whole.

Figure 7:
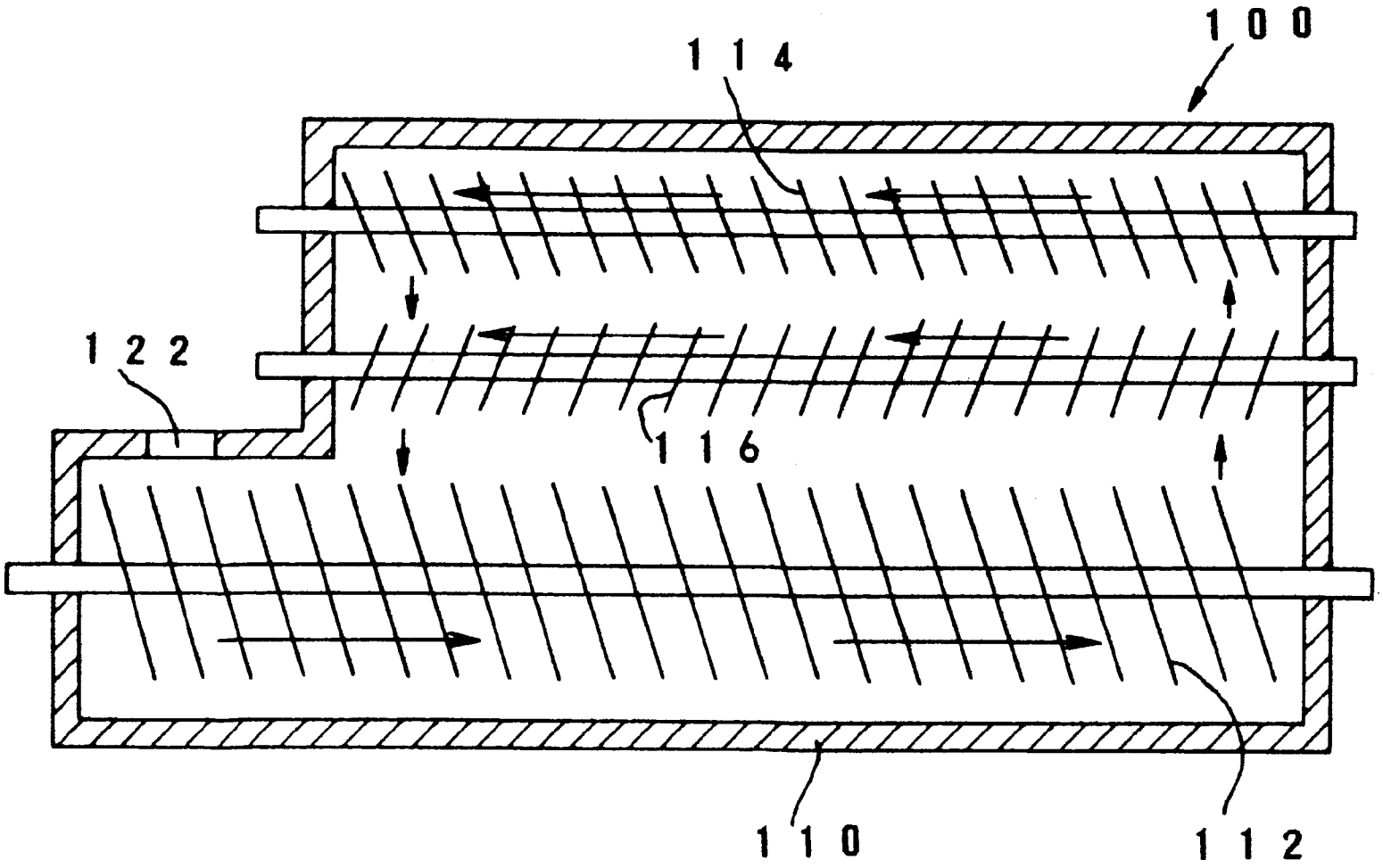
FIG. 7 is a drawing illustrating the structure of the developing device pertaining to the second preferred embodiment.
Figure 8:
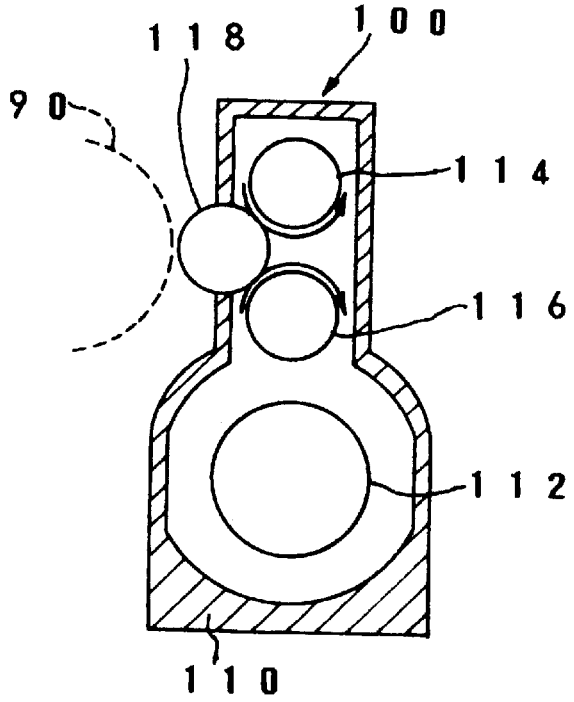
FIG. 8 is a side cross-sectional view of the developing device pertaining to FIG. 7.

FIG. 7 is a drawing illustrating the structure of developing device 100 pertaining to a second preferred embodiment of the present invention. In developing device 100, as shown in FIG. 7, the three members of mixing screw 112, supply screw 114, and collection screw 116 are provided parallel to each other within developer reservoir 110. At each of these members, multiple screw vanes are furnished obliquely at a rotatable axis. As shown in the side cross-sectional view of FIG. 8, these three screws are disposed in a vertically stacked manner respectively positioned with supply screw 114 at an upper level, collection screw 116 at a central level, and mixing screw 112 at a lower level. Supply screw 114 and collection screw 116 are the same length, but mixing screw 112 is longer than these screws. Toner replenishing port 122 is provided at this area; namely, the location in developer reservoir 110 where mixing screw 112 is longer than supply screw 114 and collection screw 116. Viewed from the region where developing roller 118 is present, the location of toner replenishing port 122 is the upstream side of the transport direction of mixing screw 112.

Developing roller 118 is furnished in a state partially protruding from developer reservoir 110, in a vertical location between supply screw 114 and collection screw 116. Developing roller 118 is positioned in close proximity to photosensitive drum 90 of an image forming apparatus, provides toner to an electrostatic latent image on photosensitive drum 90, and develops the same.

Developing device 100 allows the three members of mixing screw 112, supply screw 114, and collection screw 116 to accept rotatable drive from a motor provided in an image forming apparatus unit. Among these, supply screw 114 and collection screw 116 are devised such that their rotational directions are mutually opposed. Within FIG. 7, this rotational drive produces a leftward flow of developer at supply screw 114 and collection screw 116, and a rightward flow at mixing screw 112. This flow circulates a developer through the inside of developing device 100.

The operation of developing device 100 is next described. When mixing screw 112, supply screw 114, and collection screw 116 are rotated by drive from a motor provided in the image forming apparatus unit, the transporting force of each screw generates a flow of developer within developer reservoir 110. The flow at supply screw 114 and collection screw 116 is leftward in FIG. 7. Developer which has reached the left end of supply screw 114 and collection screw 116 in FIG. 7 by means of this flow, that is, the downstream end, falls by gravity and migrates to the underlying mixing screw 112. Meanwhile, the flow at mixing screw 112 is rightward in FIG. 7. Developer which has reached the right end of mixing screw 112 in FIG. 7 by means of this flow, that is, the downstream end, is spewed upwards and migrates to collection screw 116, and then from collection screw 116 to supply screw 114. In this way, developer within developer reservoir 110 is circulated counter-clockwise within FIG. 7.

In this circulation of developer, mixing screw 112 is responsible for mixing the developer. This mixing creates a uniform toner concentration (blending ratio of toner) and static charge in the developer. Likewise, supply screw 114 is responsible for supplying developer to developing roller 118, as is collection screw 116 for collecting excess developer from developing roller 118. Developer which has arrived downstream of supply screw 114 and collection screw 116 and fallen to mixing screw 112 is mixed by mixing screw 112 during rightward transport in FIG. 7, without migrating to supply screw 114. This is because mixing screw 112 is disposed at the lowest level. Thus, the developer is adequately mixed when migrating from the downstream end of mixing screw 112 to supply screw 114, and toner concentration and static charge are in a uniform state. Consequently, because only adequately mixed developer is supplied to supply screw 114, developing roller 118 performs developing free from density disparities caused by nonuniform toner concentration and from fogging caused by insufficient static charge.

The toner concentration of developer collected from developing roller 118 by collection screw 116 is reduced by the amount of toner consumed by developing. Thus, if developing is continued without change, the toner concentration throughout the developer will decline gradually; therefore, toner must be injected from toner replenishing port 122 to supplement the concentration as appropriate.

Injected toner falls on the upstream region of mixing screw 112 and is first transported rightward in FIG. 7. Then, the injected toner converges with developer migrating from supply screw 114 and collection screw 116 and the toner and developer are mixed by mixing screw 112. Toner just injected is not adequately blended with the developer as a whole, and its static charge is also inadequate. However, because mixing screw 112 is disposed at the lowest level, developer is not supplied to supply screw 114 by the effect of gravity during transport by mixing screw 112. In other words, prior to reaching supply screw 114 and being supplied to developing roller 118, newly injected toner is transported rightward in FIG. 7 along nearly the entire length of mixing screw 112 and is adequately mixed with the developer in that interval. Thus, when migrating from the downstream end of mixing screw 112 to supply screw 114, injected toner has been adequately blended with the developer as a whole and has assumed a uniform toner concentration; the state of static charge is also good. Consequently, even when toner is injected from toner replenishing port 122, developing roller 118 performs developing free from density disparities caused by nonuniform toner concentration and from fogging caused by insufficient static charge.

As described in detail above, according to developing device 100 pertaining to the foregoing second preferred embodiment, mixing screw 112 handling the mixing of a developer is provided separately from supply screw 114 and collection screw 116, which respectively handle the supply and collection of a developer to developing roller 118; and because mixing screw 112 is disposed downward from supply screw 114 and collection screw 116, developer transported downstream by supply screw 114 or collection screw 116 must travel across mixing screw 112 and is not supplied to supply screw 114 by the effect of gravity during such transport. Consequently, developer is transported along nearly the entire length of mixing screw 112 before being resupplied upstream of supply screw 114 and is adequately mixed in that interval.

In addition, because toner replenishing port 122 is provided at an upstream location in the transport direction of mixing screw 112, even when toner is injected, inadequately mixed developer is not supplied to supply screw 114 during transport by mixing screw 112. Consequently, injected toner is transported along nearly the entire length of mixing screw 112 before being supplied upstream of supply screw 114 and is adequately mixed with the developer in that interval. Thus, disparities in image density or fogging, etc. are prevented from arising as a result of inflow to supply screw 114 of a developer with a nonuniform toner concentration or static charge caused by insufficient mixing. Furthermore, because the three members of supply screw 114, collection screw 116, and mixing screw 112 are disposed vertically, a compact width dimension is achieved.

Figure 9:
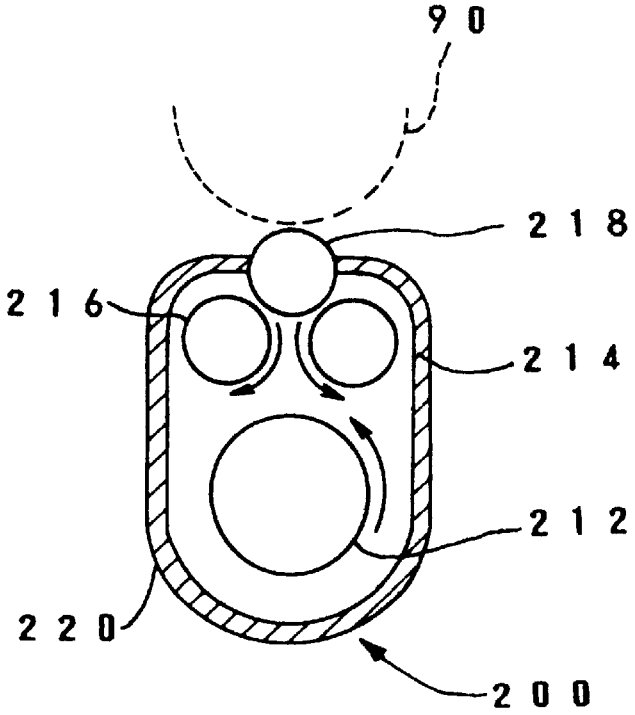
FIG. 9 is a drawing illustrating the structure of the developing device pertaining to the third preferred embodiment.

A third preferred embodiment is next described. As shown in FIG. 9, developing device 200 pertaining to the third preferred embodiment achieves a compact height dimension by disposing supply screw 214 and collection screw 216 in parallel at the same vertical position and disposing mixing screw 212 parallel to and downward from these screws. These screws are the same as the screws in the second preferred embodiment; mixing screw 212 is longer than supply screw 214 and collection screw 216; and toner replenishing port 122 (not illustrated) is provided in this area, as in the second preferred embodiment.

At a location upward from supply screw 214 and collection screw 216, developing roller 218 is provided in a state confronting photosensitive drum 90 and partially protruding from developer reservoir 220.

In developing device 200, when a motor is rotated by control from an image forming apparatus, the three members of mixing screw 212, supply screw 214, and collection screw 216 are subjected to rotary drive, and the transporting force of each screw generates a flow of developer within developer reservoir 220. Developer which has reached the downstream end at supply screw 214 and collection screw 216 by means of this flow falls by gravity and migrates to underlying mixing screw 212. Meanwhile, developer which has reached the downstream end at mixing screw 212 is spewed upward and migrates to supply screw 214. In this way, developer within developer reservoir 220 is circulated.

In this circulation of developer, mixing screw 212 mixes the developer, creating a uniform toner concentration and static charge status in the developer. In addition, supply screw 214 supplies developer to developing roller 218, and collection screw 216 collects excess developer from developing roller 218. Additionally, developer arriving downstream of supply screw 214 and collection screw 216 and falling on mixing screw 212 is mixed during transport by mixing screw 212 without migrating to supply screw 214. This is because mixing screw 212 is disposed at the lowest level. Thus, the developer is adequately mixed when migrating from the downstream end of mixing screw 212 to supply screw 214, and toner concentration and static charge are in a uniform state. Consequently, because only adequately mixed developer is supplied to supply screw 214, developing roller 218 performs developing free from density disparities caused by nonuniform toner concentration and from fogging caused by insufficient static charge.

Toner newly injected from toner replenishing port 122 falls at the upstream portion of mixing screw 212, converges with developer migrating from supply screw 214 and collection screw 216, and is mixed by mixing screw 212. Here, because mixing screw 212 is disposed at the lowest level, developer is not supplied to supply screw 214 by the effect of gravity during transport by mixing screw 212. In other words, prior to reaching supply screw 214 and being supplied to developing roller 218, newly injected toner is transported along nearly the entire length of mixing screw 212 and is adequately mixed with the developer in that interval. Thus, when migrating from the downstream end of mixing screw 212 to supply screw 214, injected toner has been adequately blended with the developer as a whole and has assumed a uniform toner concentration; the state of static charge is also good.

As described in detail above, according to developing device 200 pertaining to the foregoing third preferred embodiment, mixing screw 212 handling the mixing of a developer is provided separately from supply screw 214 and collection screw 216, which respectively handle the supply and collection of a developer to developing roller 218; and because mixing screw 212 is disposed downward from supply screw 214 and collection screw 216, developer transported downstream by supply screw 214 or collection screw 216 must travel across mixing screw 212 and is not supplied to supply screw 214 by the effect of gravity during such transport. Consequently, developer is transported along nearly the entire length of mixing screw 212 before being resupplied upstream of supply screw 214 and is adequately mixed in that interval.

In addition, because toner replenishing port 122 is provided at an upstream location in the transport direction of mixing screw 212, even when toner is injected, inadequately mixed developer is not supplied to supply screw 214 during transport by mixing screw 212. Consequently, injected toner is transported along nearly the entire length of mixing screw 212 before being supplied upstream of supply screw 214 and is adequately mixed with the developer in that interval. Thus, disparities in image density or fogging, etc. are prevented from arising as a result of inflow to supply screw 214 of a developer with a nonuniform toner concentration or static charge caused by insufficient mixing. In addition, a more compact lengthwise dimension than in the developing device pertaining to the second preferred embodiment is achieved by disposing supply screw 214 and collection screw 216 in parallel at the same vertical position.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing device comprising:

a developing roller which carries a developer and thereby supplies the developer for developing an image;

a supply screw which is disposed such that it faces the developing roller and which transports the developer along an axial direction of the developing roller and supplies the developer to the developing roller;

a collection screw which is disposed such that it faces the developing roller and which collects the developer from the developing roller and transports the developer along the axial direction of the developing roller, wherein the developer transport direction of the collection screw is the same as the developer transport direction of the supply screw; and a mixing screw which performs mixing of the developer while transporting the developer in a direction opposite to the developer transport direction of the supply screw and collection screw.

2. A developing device as claimed in claim 1, wherein said mixing screw is disposed above the supply screw and collection screw.

3. A developing device as claimed in claim 2, wherein said supply screw is disposed above the collection screw.

4. A developing device as claimed in claim 1, wherein said mixing screw is disposed below the supply screw and collection screw.

5. A developing device as claimed in claim 4, wherein said supply screw is disposed above the collection screw.

6. A developing device as claimed in claim 4, wherein said supply screw is disposed at the same height as the collection screw.

7. A developing device as claimed in claim 1, further comprising a developer supply port arranged at the upstream side of a region which confronts the developing roller in the developer transport direction of the mixing screw.

8. A developing device as claimed in claim 1, wherein the transport capacity of said mixing screw is larger than the transport capacity of the supply screw and collection screw, respectively.

9. A developing device as claimed in claim 8, wherein a diameter of said mixing screw is larger than each of a diameter of the supply screw and a diameter of the collection screw.

10. A developing device comprising:

a developer carrier which carries a developer and thereby supplies the developer for developing an image;

a first transport member which is disposed such that it faces the developer carrier and which supplies the developer to the developer carrier while transporting the developer in a developer transport direction;

a second transport member which is disposed such that it faces the developer carrier and which collects the developer from the developer carrier and transports the developer in the same developer transport direction as the first transport member; and a third transport member which performs mixing of the developer while transporting the developer in a developer transport direction opposite to the developer transport direction of the first and second transport members.

11. A developing device as claimed in claim 10, wherein said third transport member is disposed above the first and second transport members.

12. A developing device as claimed in claim 11, wherein said first transport member is disposed above the second transport member.

13. A developing device as claimed in claim 10, wherein said third transport member is disposed below the first and second transport members.

14. A developing device as claimed in claim 13, wherein said first transport member is disposed above the second transport member.

15. A developing device as claimed in claim 13, wherein said first transport member is disposed at the same height as the second transport member.

16. A developing device as claimed in claim 10, further comprising a developer supply port arranged at the upstream side of a region which confronts the developer carrier in the developer transport direction of the third transport member.

17. A developing device as claimed in claim 10, wherein a developer transport capacity of said third transport member is larger than each of a developer transport capacity of the first transport member and a developer transport capacity of the second transport member.

* * * * *